US010737514B2

(12) United States Patent
Oguchi et al.

(10) Patent No.: US 10,737,514 B2
(45) Date of Patent: Aug. 11, 2020

(54) SHEET CASSETTE CAPABLE OF SUPPLYING ELECTRIC POWER TO OUTSIDE AND PRINTING APPARATUS INCLUDING SAME

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/299,534

(22) Filed: Mar. 12, 2019

(65) Prior Publication Data

US 2019/0291477 A1 Sep. 26, 2019

(30) Foreign Application Priority Data

Mar. 23, 2018 (JP) ..... 2018-055905

(51) Int. Cl.

| | |
|---|---|
| ***B41J 11/58*** | (2006.01) |
| ***B65H 1/04*** | (2006.01) |
| ***B65H 5/06*** | (2006.01) |
| ***B41J 3/36*** | (2006.01) |
| ***B65H 1/26*** | (2006.01) |
| ***B41J 13/10*** | (2006.01) |

(52) U.S. Cl.

CPC ..... *B41J 11/58* (2013.01); *B41J 3/36* (2013.01); *B41J 13/103* (2013.01); *B65H 1/04* (2013.01); *B65H 1/266* (2013.01); *B65H 5/062* (2013.01); *B65H 2402/41* (2013.01); *B65H 2405/313* (2013.01)

(58) Field of Classification Search

CPC . B41J 11/58; B41J 13/103; B41J 3/36; B65H 1/266; B65H 5/062; B65H 1/04; B65H 2405/313; B65H 2402/41

See application file for complete search history.

(56) References Cited

U.S. PATENT DOCUMENTS

| | | | | |
|---|---|---|---|---|
| 2,024,622 A | | 12/1935 | Bates | |
| 3,748,984 A | | 7/1973 | Gold | |
| 5,002,266 A | * | 3/1991 | Kikuchi | B41J 13/00 271/109 |
| 5,294,106 A | * | 3/1994 | Takagi | B65H 1/04 271/162 |
| 5,850,243 A | * | 12/1998 | Kinoshita | B41J 2/01 347/108 |
| 6,523,933 B1 | | 2/2003 | Hirano et al. | |
| 7,922,273 B2 | * | 4/2011 | Silverbrook | B41J 2/01 347/2 |

(Continued)

FOREIGN PATENT DOCUMENTS

| | | |
|---|---|---|
| CN | 1289684 | 4/2001 |
| JP | S58-5762 U | 1/1983 |

(Continued)

*Primary Examiner* — Henok D Legesse

(74) *Attorney, Agent, or Firm* — IPUSA, PLLC

(57) ABSTRACT

A sheet cassette connectable to a printer includes a storage part, a battery, and an electrode terminal. The storage part is configured to store a recording sheet. The sheet cassette is configured to supply the electric power of the battery to the printer through the electrode terminal.

8 Claims, 17 Drawing Sheets

(56) References Cited

U.S. PATENT DOCUMENTS

| | | | | |
|---|---|---|---|---|
| 2007/0290433 | A1* | 12/2007 | Mushimoto | B65H 3/54<br>271/160 |
| 2010/0316427 | A1* | 12/2010 | Sago | B41J 3/36<br>400/615.2 |
| 2016/0137444 | A1* | 5/2016 | Kasaishi | B65H 5/36<br>271/9.09 |

FOREIGN PATENT DOCUMENTS

| | | |
|---|---|---|
| JP | S61-127529 | 6/1986 |
| JP | H8-25729 | 1/1996 |
| JP | 2004-345819 | 12/2004 |
| JP | 2006-159427 | 6/2006 |

* cited by examiner

SHEET CASSETTE CAPABLE OF SUPPLYING ELECTRIC POWER TO OUTSIDE AND PRINTING APPARATUS INCLUDING SAME

CROSS-REFERENCE TO RELATED APPLICATION

The present application is based on and claims priority to Japanese patent application No. 2018-055905, filed on Mar. 23, 2018, the entire contents of which are incorporated herein by reference.

BACKGROUND OF THE INVENTION

1. Field of the Invention

The present invention relates to sheet cassettes and printing apparatuses.

2. Description of the Related Art

Conventional portable printers have a box shape and are relatively large, and are carried in a bag or the like. Portable printers are preferably small, light, and easy to carry. For portable printers, a sheet cassette for storing recording sheets may be used. See, for example, Japanese Laid-open Patent Publication Nos. 2006-159427 and 2004-345819.

SUMMARY OF THE INVENTION

According to an aspect of the present invention, a sheet cassette connectable to a printer includes a storage part, a battery, and an electrode terminal. The storage part is configured to store a recording sheet. The sheet cassette is configured to supply the electric power of the battery to the printer through the electrode terminal.

DESCRIPTION OF THE EMBODIMENTS

Figure 1:
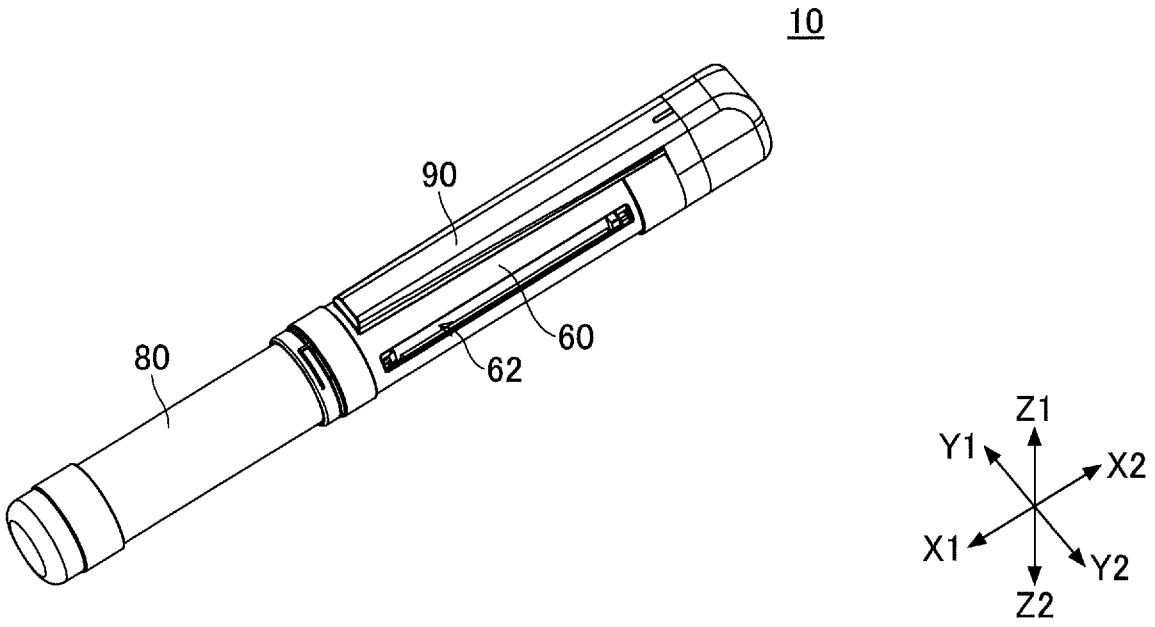
FIGS. 1 and 2 are a perspective view and a cross-sectional view, respectively, of a printer.

Portable printers contain a battery and are driven with electric power stored in the battery. To make portable printers as small as possible, small, low-capacity batteries are used.

While high-speed printing is not performable with small, low-capacity batteries, small portable printers that can perform high-speed printing are desired.

According to an aspect of the present invention, a sheet cassette is connected to a portable printer to enable the portable printer to perform high-speed printing.

Embodiments of the present invention are described below with reference to the accompanying drawings. In the following, the same members or the like are referred to using the same reference numeral, and duplicate description thereof is omitted. Furthermore, the embodiments are described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are orthogonal to one another.

First Embodiment

Figure 2:
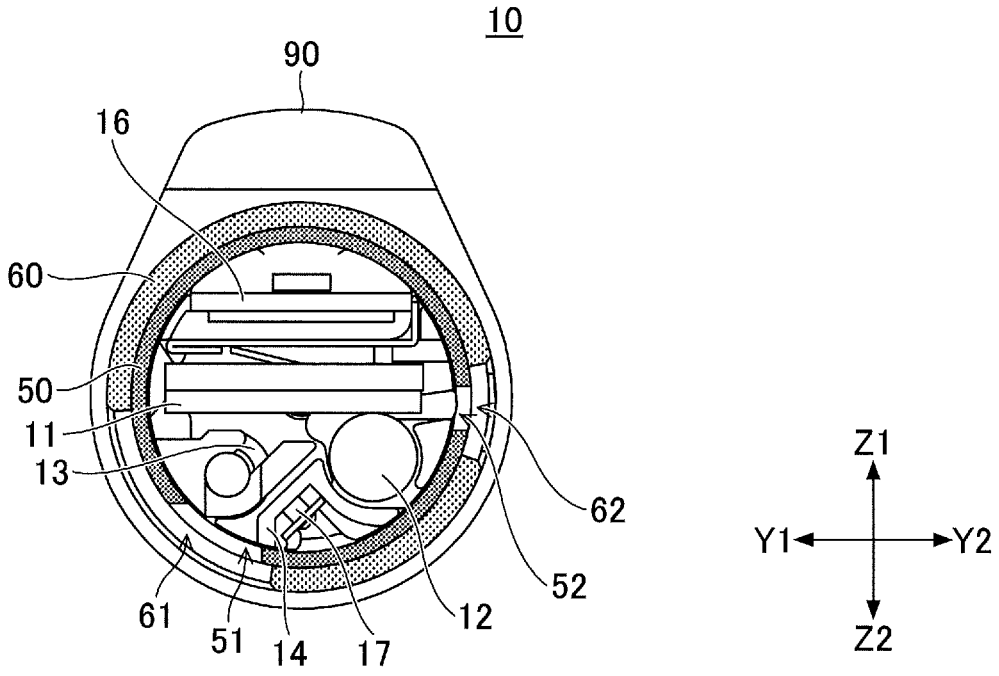

A portable printer 10 to which a sheet cassette according to an embodiment is attachable is described with reference to FIGS. 1 and 2. The cylindrical printer 10 is also referred to as a pen-type printer. FIGS. 1 and 2 are a perspective view and a cross-sectional view, respectively, of the printer 10. The printer 10 is an Internet of Things (IoT) device including a printing function and a radio communication function.

The printer 10 includes a print head 11 such as a thermal head, a platen roller 12, a feed roller 13, a sheet guide 14, a spring, a control board 16, an insertion opening sensor 17, an inner cover 50, and an outer cover 60. The print head 11 is pressed against the platen roller 12 by the spring. A recording sheet is fed by the feed roller 13 to move into the printer 10 along the sheet guide 14. The recording sheet is conveyed by the platen roller 12 while being held between the print head 11 and the platen roller 12, and is thereafter discharged. An electronic circuit and electronic components that control the printer 10 are mounted on the control board 16.

The cylindrical inner cover 50 is accommodated in the cylindrical outer cover 60. The inner cover 50 includes an insertion opening 51 and a discharge opening 52 that are open along the generatrix of the inner cover 50. The outer cover 60 includes an insertion opening 61 and a discharge opening 62 that are open along the generatrix of the outer cover 60. The outer cover 60 is rotatable relative to the inner cover 50.

When the printer 10 performs printing, the opening 51 and the opening 61 are aligned to be open, and the opening 52 and the opening 62 are aligned to be open. A recording sheet enters the printer 10 through the openings 51 and 61, and is discharged through the openings 52 and 62. A sheet cassette 100 can be connected to the opening 61 with the openings 51 and 61 being open.

Print data are transmitted from an information terminal to the printer 10 through radio communications using, for example, Bluetooth Low Energy (BLE). The printer 10 receives the print data and performs printing on a recording sheet. The printer 10 contains a built-in antenna for performing radio communications.

The printer 10 includes a power supply 80 storing a lithium-ion battery, which is a rechargeable battery, and can be driven with electric power supplied from the lithium-ion battery. The printer 10 includes a built-in connector for charging a rechargeable battery. In this specification, the battery contained in the printer 10 may be referred to as "printer battery."

The printer 10, which is approximately 18 mm in diameter and approximately 165 mm to 170 mm in length, can be carried around without feeling stress. The printer 10 includes a hook 90 which allows the printer 10 to be put in the chest pocket of clothes to be carried around just like a pen.

Figure 3:
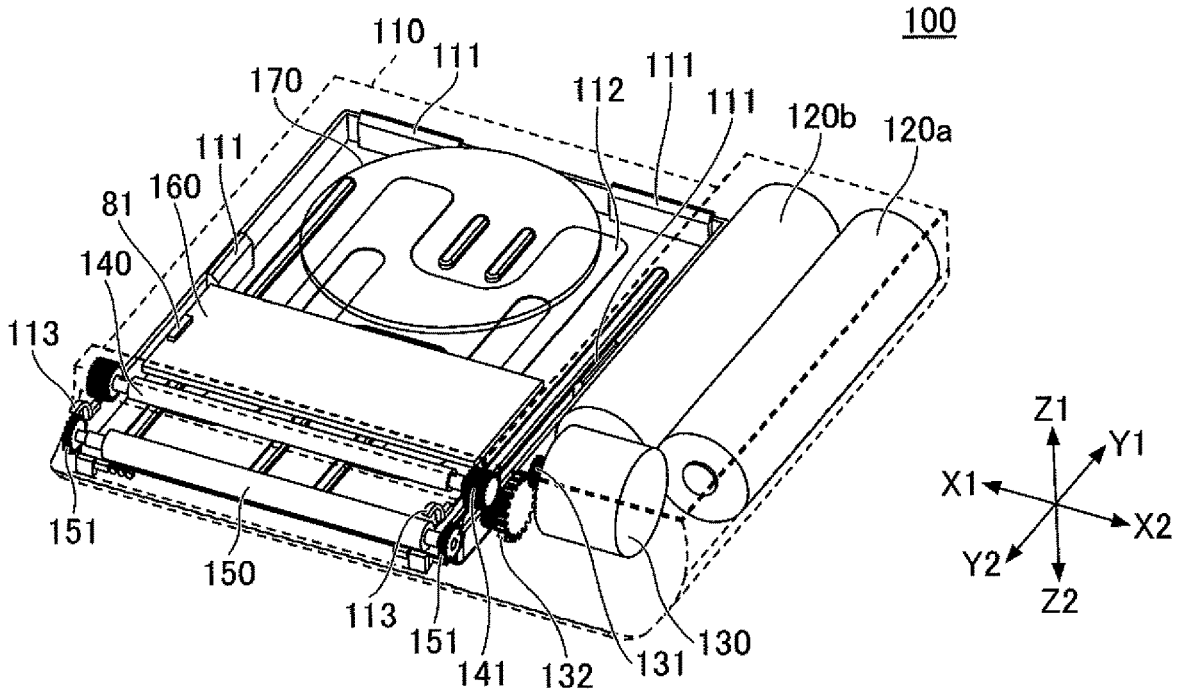
FIGS. 3 and 4 are partially phantom perspective views of a sheet cassette according to a first embodiment.
Figure 4:
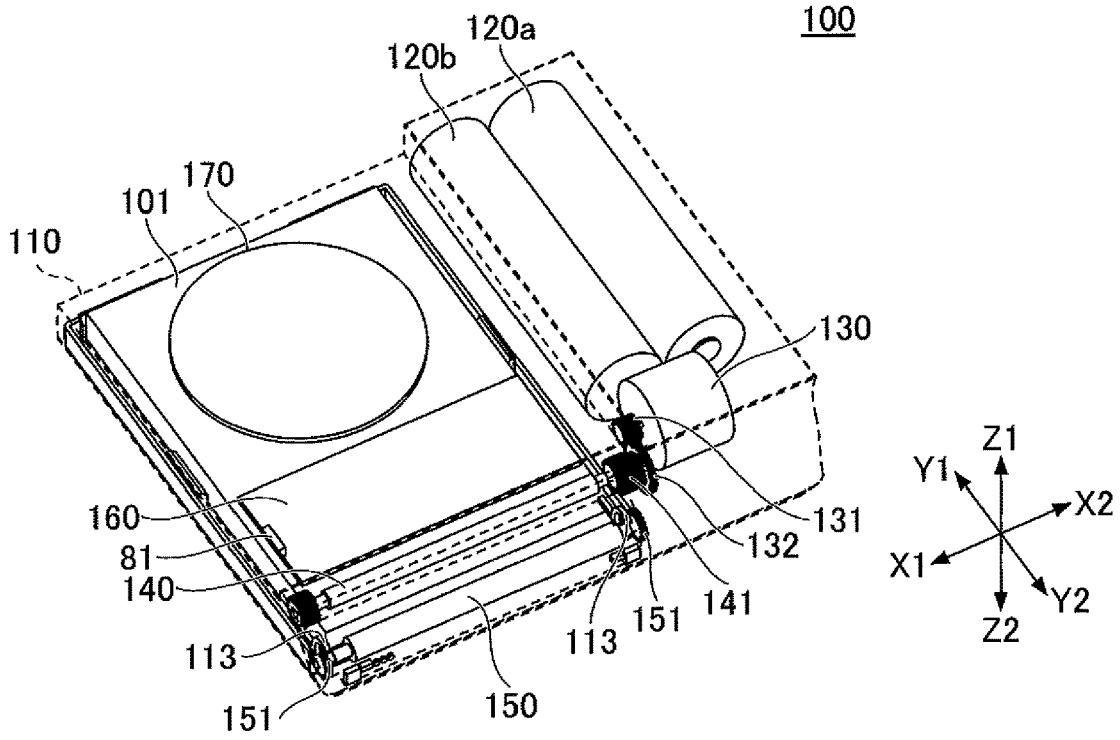
Figure 5:
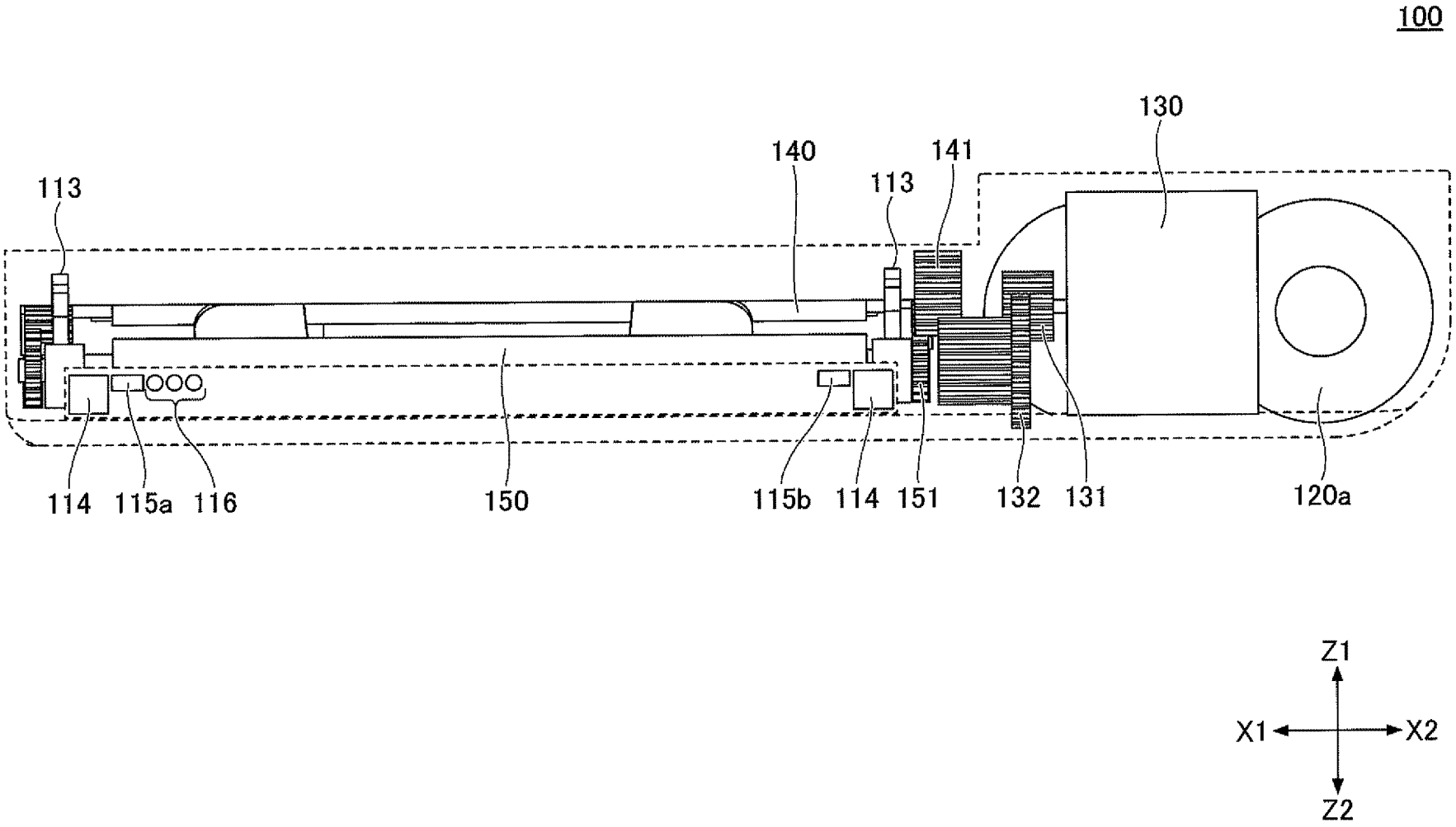
FIG. 5 is a partially phantom front view of the sheet cassette according to the first embodiment.

The cassette 100 according to this embodiment is attached to the printer 10. FIG. 3 is a phantom perspective view of a housing 110 of the cassette 100. FIG. 4 is a perspective view of the cassette 100 from another angle. FIG. 5 is a front view of the cassette 100.

The cassette 100 can store recording sheets 101 in the housing 110, and includes two rechargeable batteries 120*a* and 120*b*, a motor 130, a feed roller 140, an assist roller 150, a control board 160, and a coil 170 for power transmission. The control board 160 is provided with a universal serial bus (USB) connector 81.

Sheet guides 111 are so provided in the housing 110 as to extend on three sides of the recording sheets 101 to control the position of the recording sheets 101, so that the recording sheets 101 are placed inside the sheet guides 111 as illustrated in FIG. 4. In this specification, a section for storing recording sheets defined by the sheet guides 111 may be referred to as "storage part," and the batteries 120*a* and 120*b* may be collectively referred to as "battery 120."

A spring 112 is provided at the bottom of the storage part to press the stacked recording sheets 101 upward in the Z1 direction.

The batteries 120*a* and 120*b* are connected in series. The printer battery is a single-cell rechargeable battery whose nominal voltage is approximately 3.6 V, while the series-connected batteries 120*a* and 120*b* supply electric power of approximately 7.2 V, which is twice the nominal voltage of the printer battery. The electric power of the batteries 120*a* and 120*b* is supplied to the motor 130, the control board 160, and the coil 170, and may also be supplied to the printer 10.

The motor 130 rotates the feed roller 140. A gear 131 and a gear 141 are attached to the shaft of the motor 130 and the shaft of the feed roller 140, respectively. A gear 132 is provided between the gears 131 and 141.

In a view from the X2 side, when the motor 130 rotates clockwise, the gear 131 also rotates clockwise, so that the gear 132 meshing with the gear 131 rotates counterclockwise. When the gear 132 rotates counterclockwise, the gear 141 meshing with the gear 132 rotates clockwise, so that the feed roller 140 also rotates clockwise. The feed roller 140 is in contact with the topmost recording sheet 101. As the feed roller 140 rotates clockwise, the recording sheets 101 contacting the feed roller 140 are conveyed one by one to the Y2 side to be fed to the printer 10.

Two claws 113 for attaching the cassette 100 to the printer 10 are provided at the Y2 end of the cassette 100. The cassette 100 can be attached to the printer 10 by hooking the claws 113 over the shaft of the feed roller 13.

The assist roller 150 rotates independent of the feed roller 140. As described below, when the cassette 100 is attached to the printer 10, the assist roller 150 rotates in tandem with the rotating feed roller 13 to assist feeding of the recording sheets 101 to the printer 10.

On a Y2 surface of the cassette 100, which is a surface to be attached to the printer 10, two magnets 114 for magnetically attracting the printer 10, electrode terminals 115*a* and 115*b* for supplying electric power from the battery 120 to the printer 10, and communication terminals 116 for communicating information with the printer 10 are provided.

Figure 6:
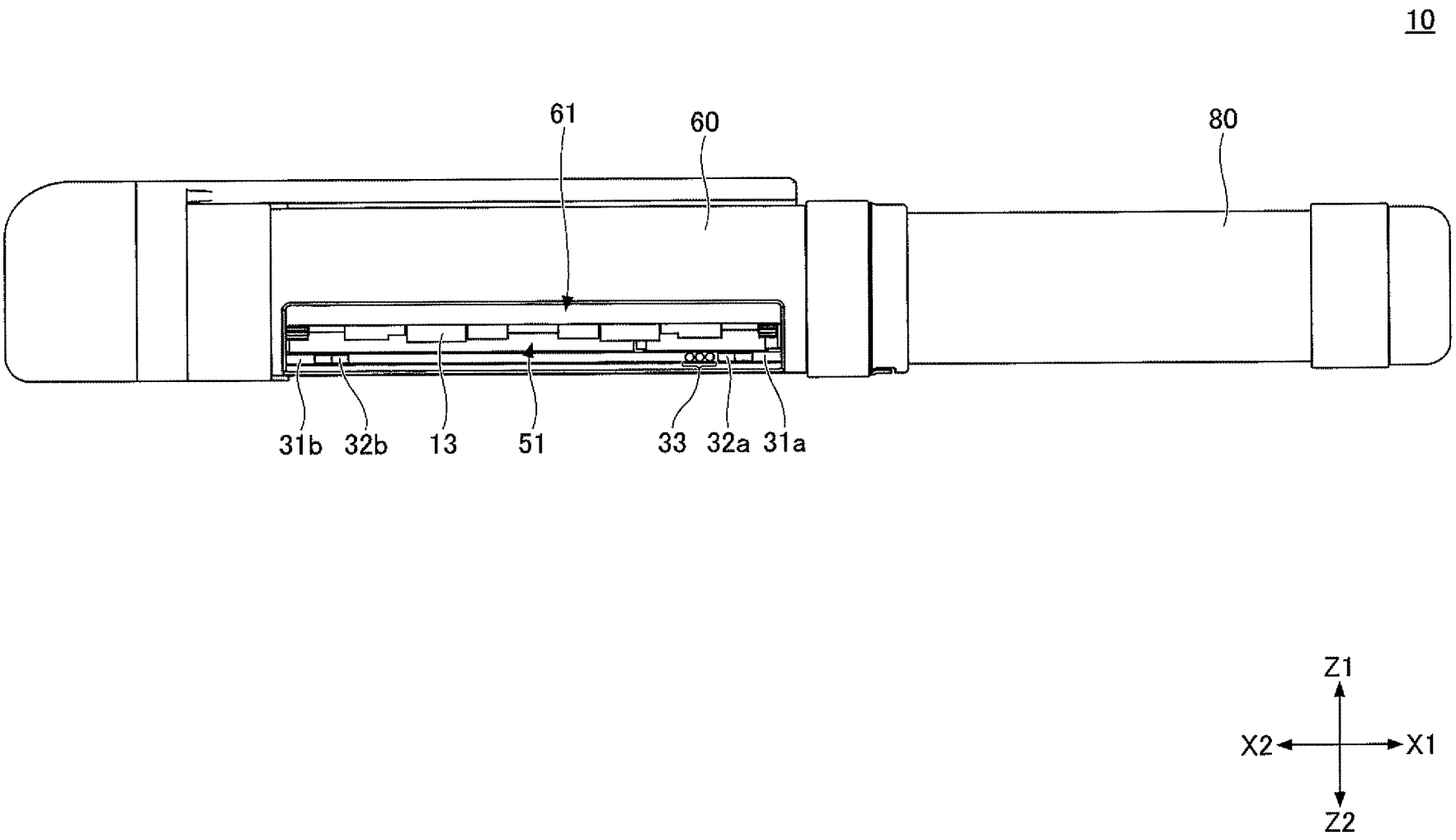
FIG. 6 is a front view of the printer.

Referring to FIG. 6, which is a front view of the printer 10, the printer 10 includes connection parts 31*a* and 31*b*, electrode terminals 32*a* and 32*b*, and communication terminals 33, which are exposed in the openings 51 and 61. The connection parts 31*a* and 31*b* are positioned one at each end of the openings 51 and 61.

The connection parts 31*a* and 31*b*, which are formed of a magnetic material such as a metal material including iron, cobalt, or nickel, are magnetically attracted to the magnets 114. The electrode terminals 32*a* and 32*b* are connected to the electrode terminals 115*a* and 115*b* to supply electric power from the cassette 100 to the printer 10. The communication terminals 33 are connected to the communication terminals 116 to perform serial data information communications between the printer 10 and the cassette 100.

When the printer 10 is magnetically attracted and connected to the cassette 100 by the magnets 114, the electrode terminals 115*a* and 115*b* contact the electrode terminals 32*a* and 32*b*, respectively, so that the electric power of the battery 120 can be supplied from the cassette 100 to the printer 10. Furthermore, the communication terminals 116 contact the communication terminals 33, so that the cassette 100 and the printer 10 can perform communications.

The electrode terminals 115*a* and 115*b* are provided one at each end of the Y2 surface of the cassette 100. Therefore, when the cassette 100 is not connected normally to the printer 10, such as when the cassette 100 is attached at an angle to the printer 10, at least one of the electrode terminals 115*a* and 115*b* is not connected to a corresponding one of the electrode terminals 32*a* and 32*b*, so that no electric power is supplied from the cassette 100 to the printer 10. This makes it possible to prevent a recording sheet jam or damage to gears due to an operation under loose connection. One of the electrode terminals 115*a* and 115*b* is positive and the other is negative.

The printer 10 and the cassette 100 perform bidirectional communications via the communication terminals 33 and 116. Therefore, it is possible to control an operation of the cassette 100, such as driving of the motor 130, from the printer 10.

A control integrated circuit (IC) is mounted on the control board 160 to control various operations in the cassette 100, such as the rotation of the motor 130. The coil 170 is provided to wirelessly charge the printer battery. The printer 10 is placed on part of the cassette 100 where the coil 170 is provided, and a power-receiving coil provided in the printer 10 receives electromagnetic waves radiated from the power-transmitting coil 170. Thus, the printer battery can be wirelessly charged.

Figure 7:
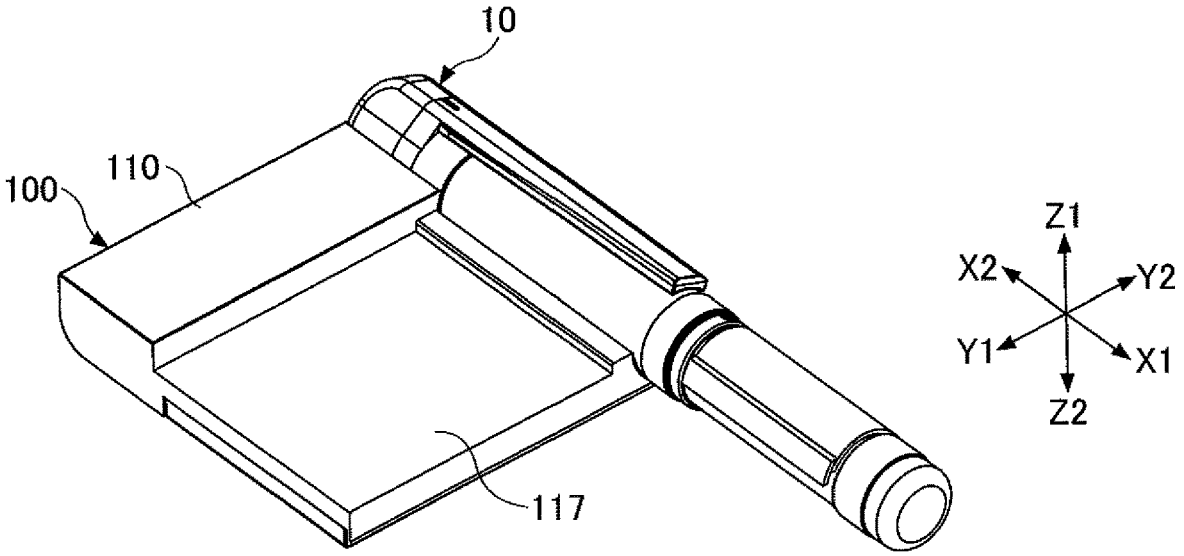
FIGS. 7 and 8 are a top-side perspective view and a bottom-side perspective view, respectively, of the sheet cassette according to the first embodiment to which the printer is attached.
Figure 8:
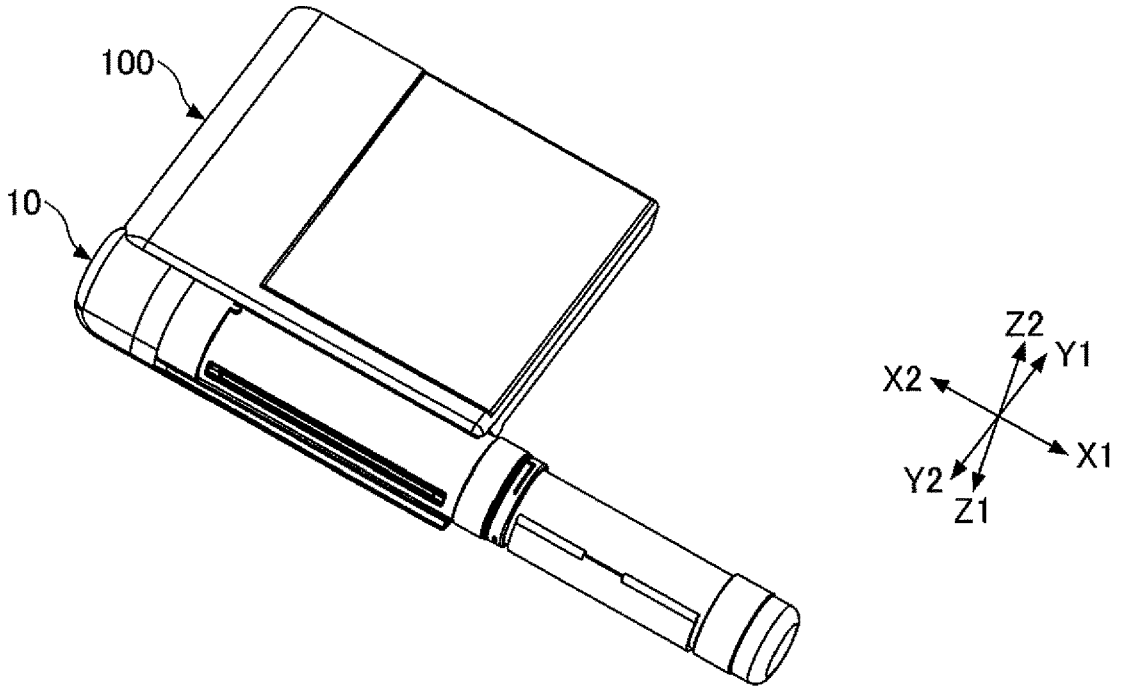

Next, a connection of the cassette 100 and the printer 10 is described. As described above, the cassette 100 is attached and connected to the printer 10 by hooking the claws 113 over the shaft of the feed roller 13. FIGS. 7 and 8 are a top-side perspective view and a bottom-side perspective view, respectively, of the printer 10 to which the cassette 100 is attached.

Figure 9:
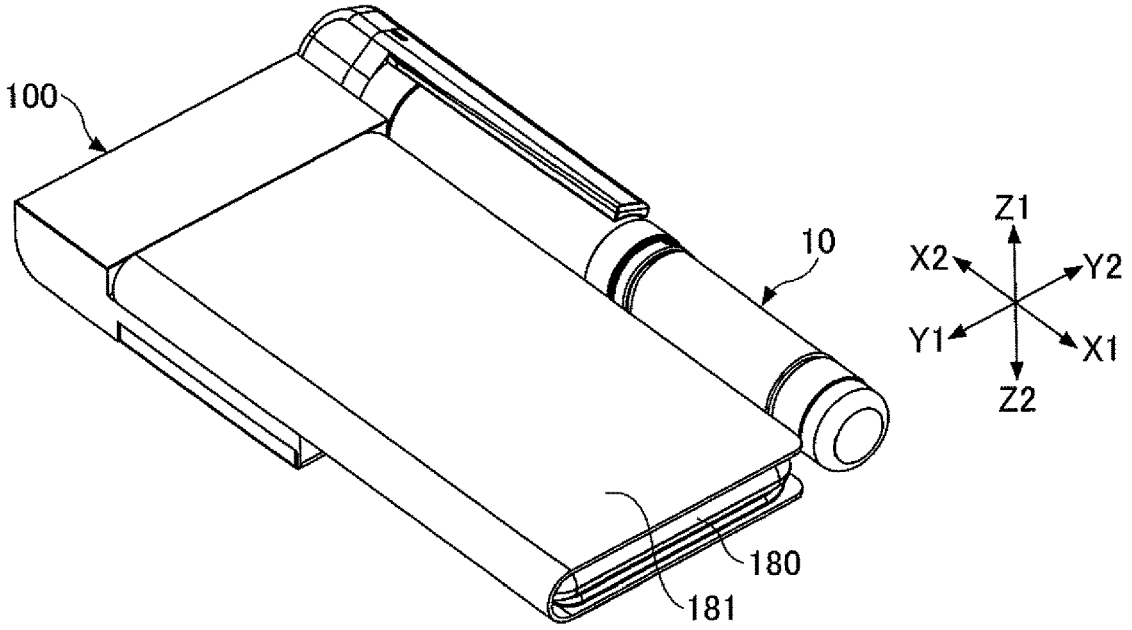
FIGS. 9, 10 and 11 are a top-side perspective view, a bottom-side perspective view and a sectional view, respectively, of the sheet cassette according to the first embodiment on which a portable terminal is placed.
Figure 10:
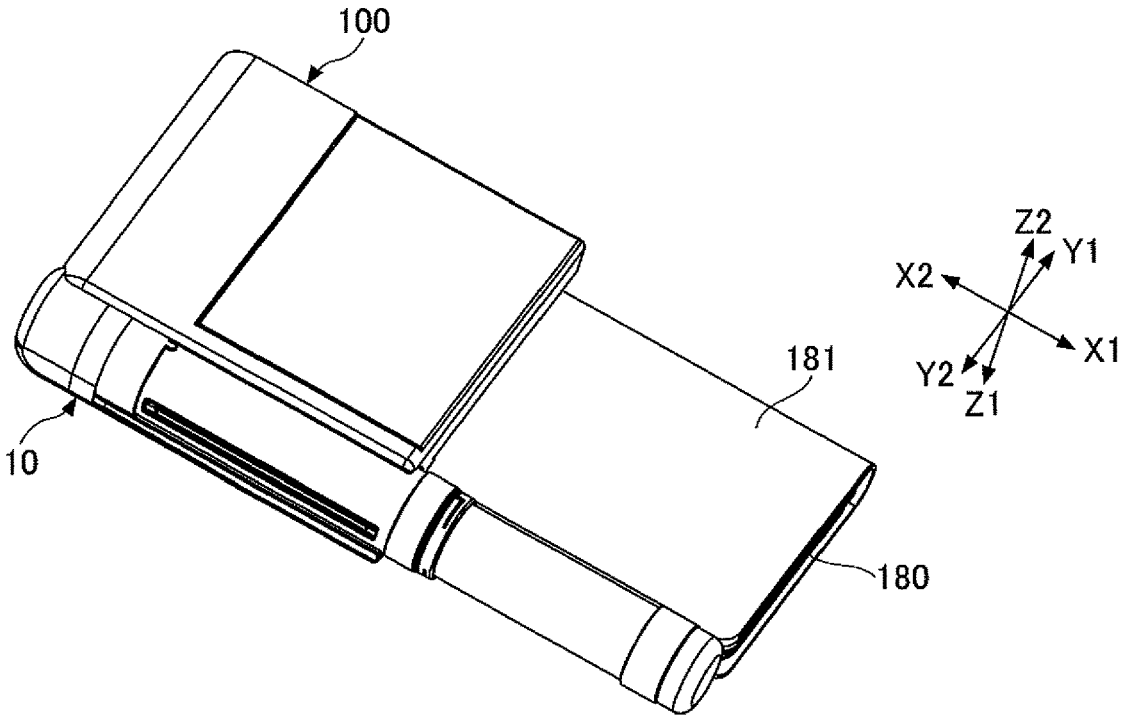

A Z1 surface of the housing 110 includes a placement area 117 for placing a portable terminal 180 such as a smartphone. The portable terminal 180 to which a cover 181 is attached may be placed on the placement area 117 as illustrated in FIGS. 9 and 10. FIGS. 9 and 10 are a top-side perspective view and a bottom-side perspective view, respectively, of the cassette 100 to which the printer 10 and the portable terminal 180 are attached.

Figure 11:
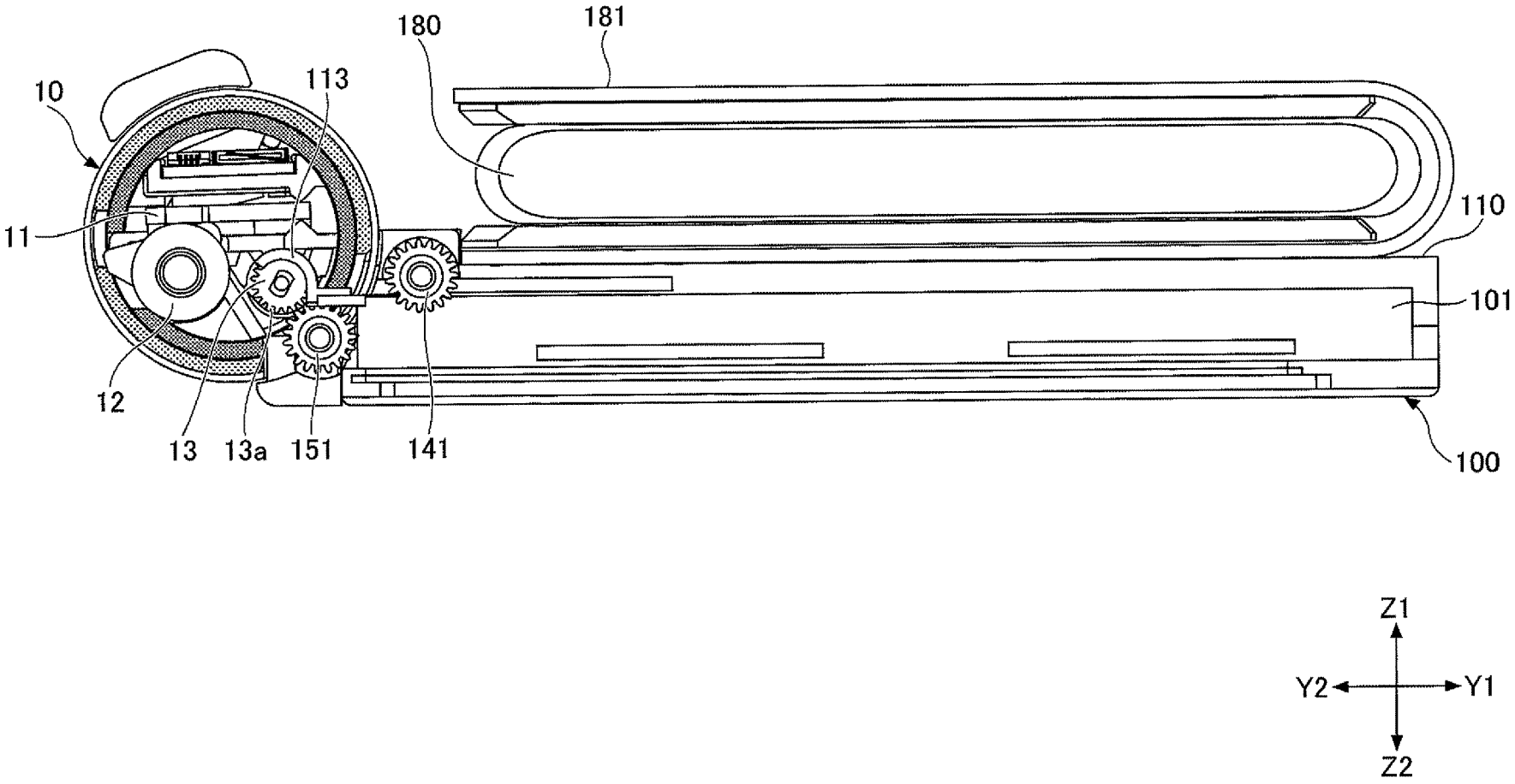

FIG. 11 is a sectional view of the cassette 100 to which the printer 10 and the portable terminal 180 are attached. With the cassette 100 attached to the printer 10, gears 13*a* of the feed roller 13 meshes with gears 151 of the assist roller 150. Therefore, the assist roller 150 rotates in tandem with the rotating feed roller 13 to assist feeding of the recording sheets 101 to the printer 10. Specifically, to perform printing on the recording sheet 101 in the state illustrated in FIG. 11, the gears 13*a* are rotated clockwise by a motor of the printer 10 to rotate the feed roller 13 clockwise, thereby conveying the recording sheet 101 from the cassette 100 toward the print head 11. When the gears 13*a* rotate clockwise, the gears 151 meshing with the gears 13*a* rotate counterclockwise, so that the assist roller 150 rotates counterclockwise.

In the cassette 100, when viewed from the X2 side, the feed roller 140 is rotated clockwise by the motor 130 to convey the recording sheet 101 to the Y2 side. When the recording sheet 101 enters the nip between the feed roller 13 and the assist roller 150, the recording sheet 101 is conveyed into the printer 10 by the feed roller 13 and the assist roller 150.

The feed roller 140 rotates independent of the feed roller 13. The conveying speed of the feed roller 13 is higher than the conveying speed of the feed roller 140 to prevent the slack in the recording sheet 101. During the conveyance of the recording sheet 101 by the feed roller 13, to prevent an adverse effect on printing, the feed roller 140 is freely rotated by the recording sheet 101 conveyed by the feed roller 13. The motor 130 stops when the leading edge of the recording sheet 101 is detected by the sensor 17 illustrated in FIG. 2. As a result, no recording sheet 101 is conveyed from the cassette 100. Therefore, it is possible to prevent the next recording sheet 101 from being fed from the cassette 100 after the end of printing on the recording sheet 101.

Figure 12:
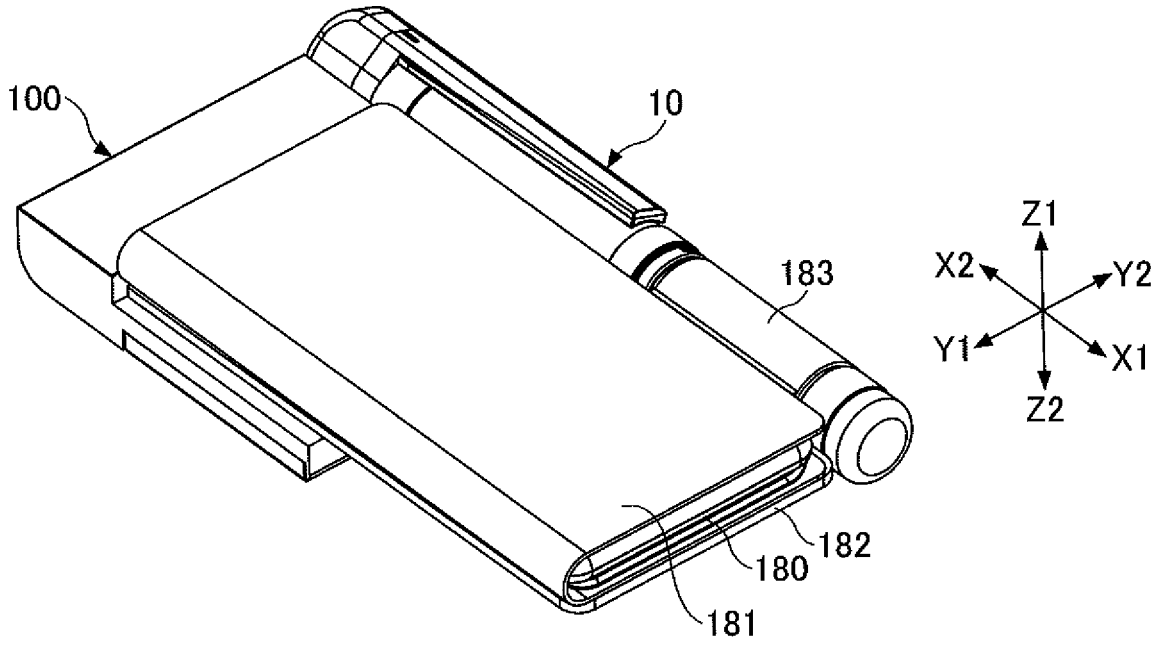
FIGS. 12 and 13 are a top-side perspective view and a bottom-side perspective view, respectively, of the sheet cassette according to the first embodiment for which an attachment plate is used.
Figure 13:
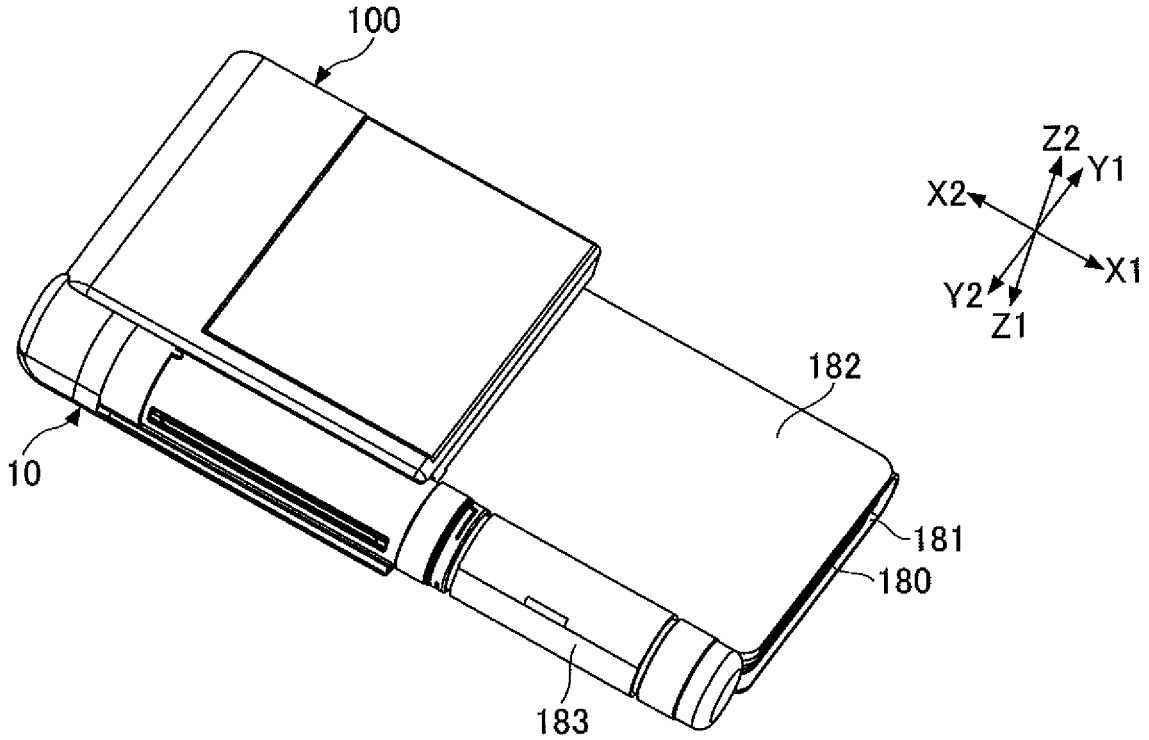
Figure 14:
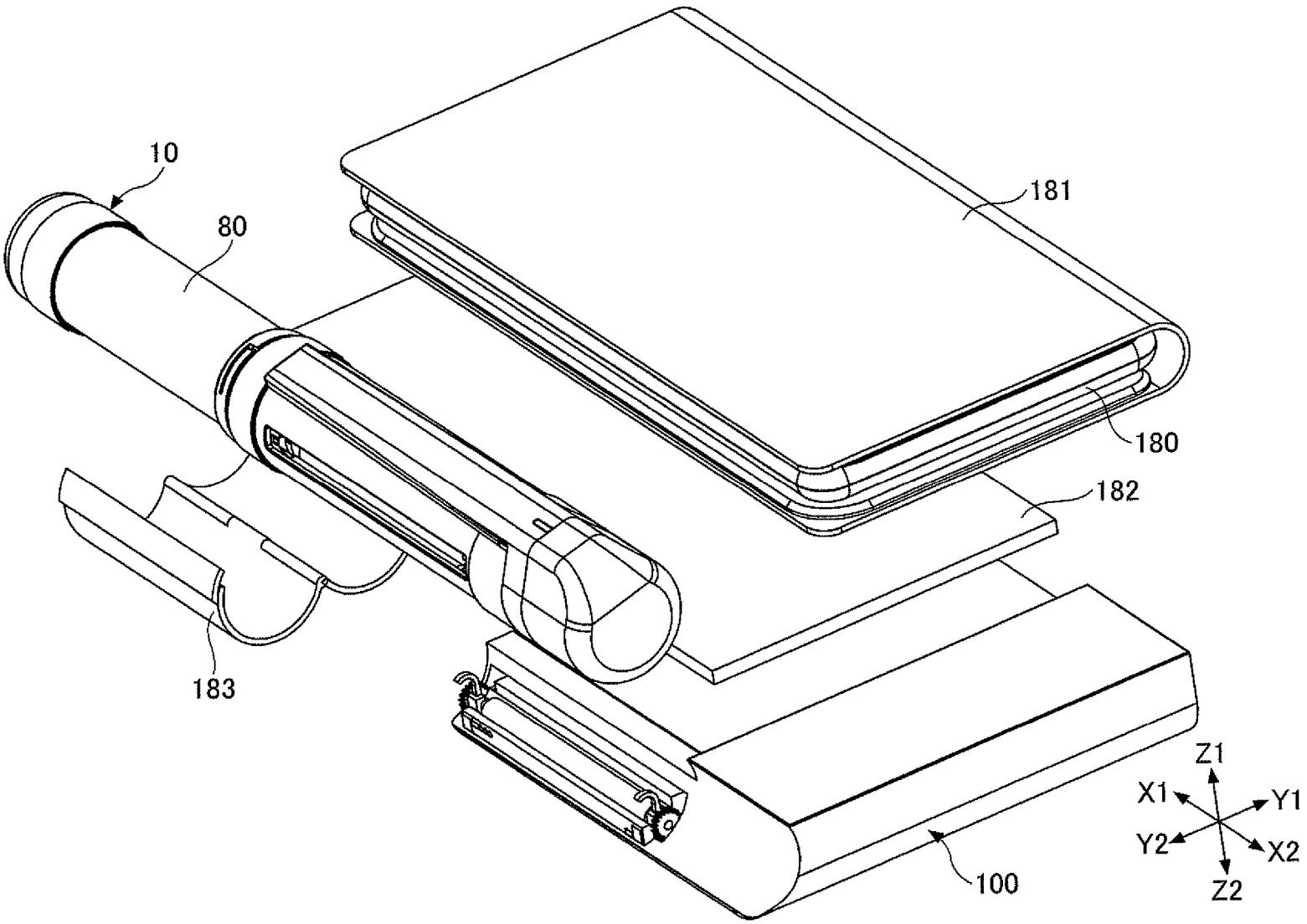
FIGS. 14 and 15 are diagrams illustrating a method of attaching the portable terminal to the printer.
Figure 15:
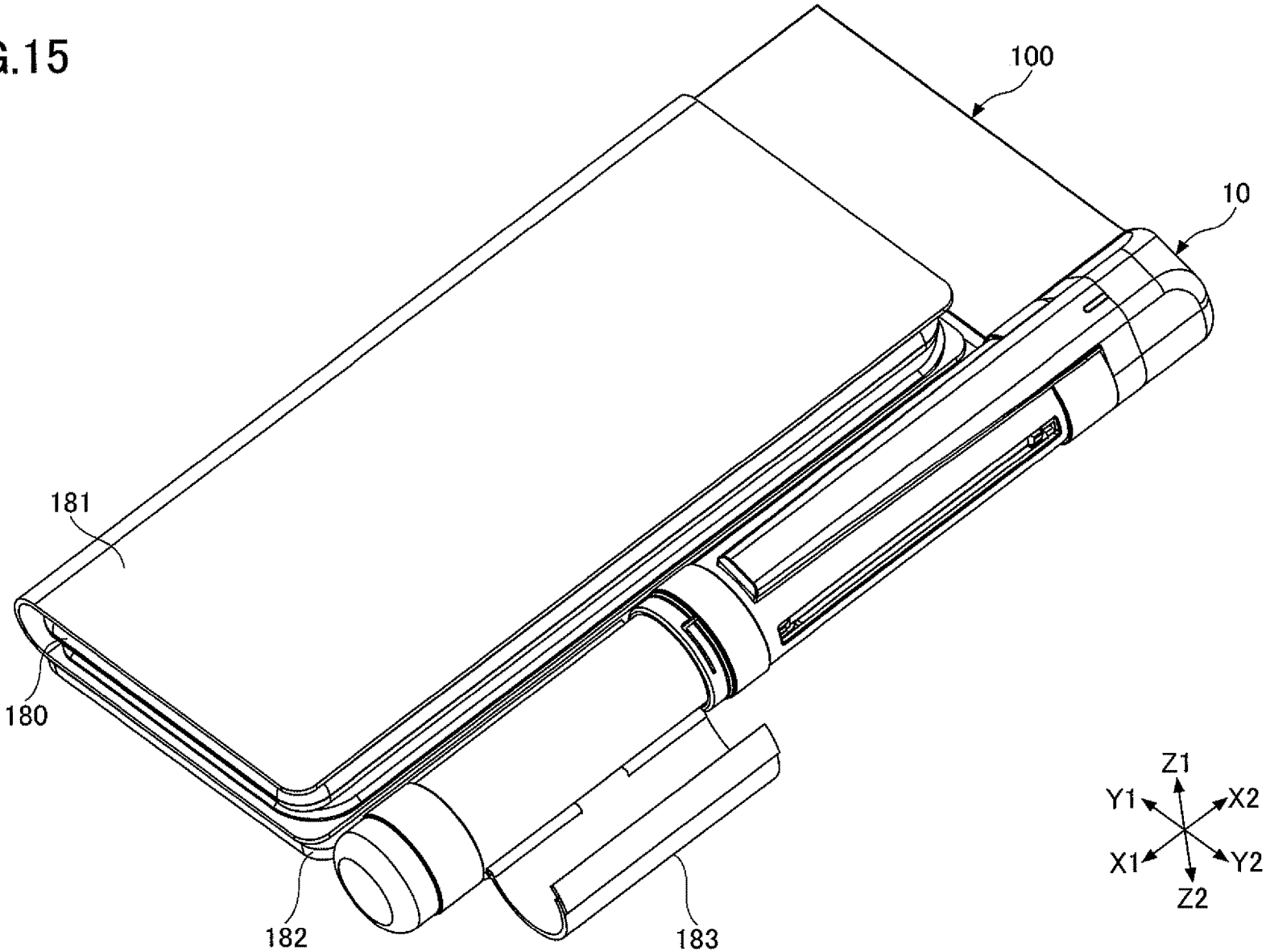

To attach the portable terminal 180 to the cassette 100, an attachment plate 182 for attaching the portable terminal 180 may be used as illustrated in FIGS. 12 through 15. FIGS. 12 and 13 are a top-side perspective view and a bottom-side perspective view, respectively, of the cassette 100 to which the portable terminal 180 is attached using the attachment plate 182. FIG. 14 is a perspective view of the portable terminal 180 with the cover 181, the attachment plate 182, the printer 10, and the cassette 100. FIG. 15 illustrates the process of attaching the attachment plate 182 to the printer 10 using a fixing band 183.

Referring to FIGS. 12 through 15, the attachment plate 182 is provided with the fixing band 183 for fixing the printer 10, and is fixed to the printer 10 by covering the power supply 80 with the fixing band 183. The attachment plate 182 and the cover 181 may be bonded together or magnetically attracted to each other with, for example, a magnet.

With the portable terminal 180 being accommodated in the cover 181 attached to the attachment plate 182 and being fixed to the printer 10 through the fixing band 183, the attachment plate 182 is placed on and attached to the placement area 117.

Figure 16:
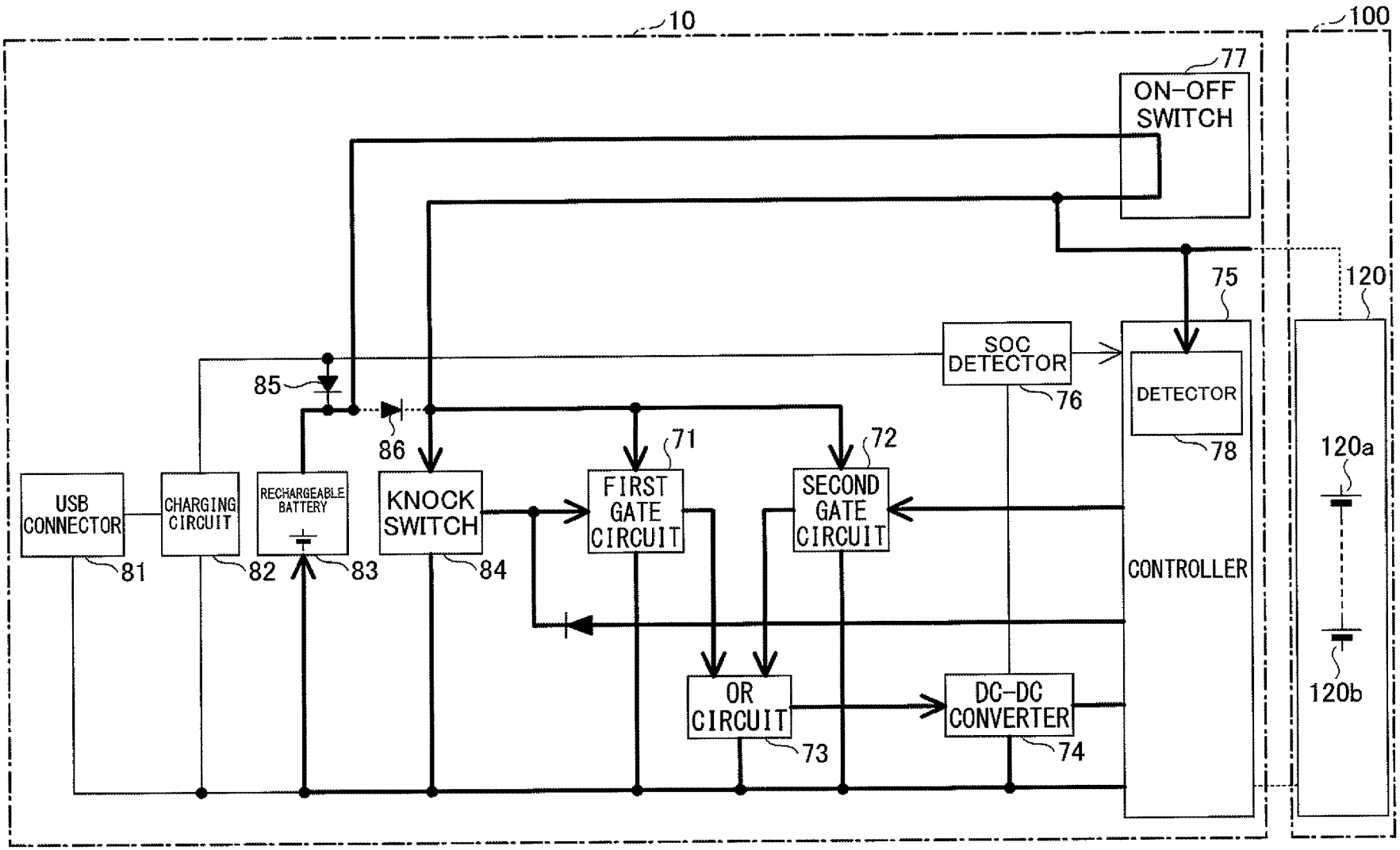
FIGS. 16 and 17 are block diagrams for illustrating the sheet cassette according to the first embodiment.
Figure 17:
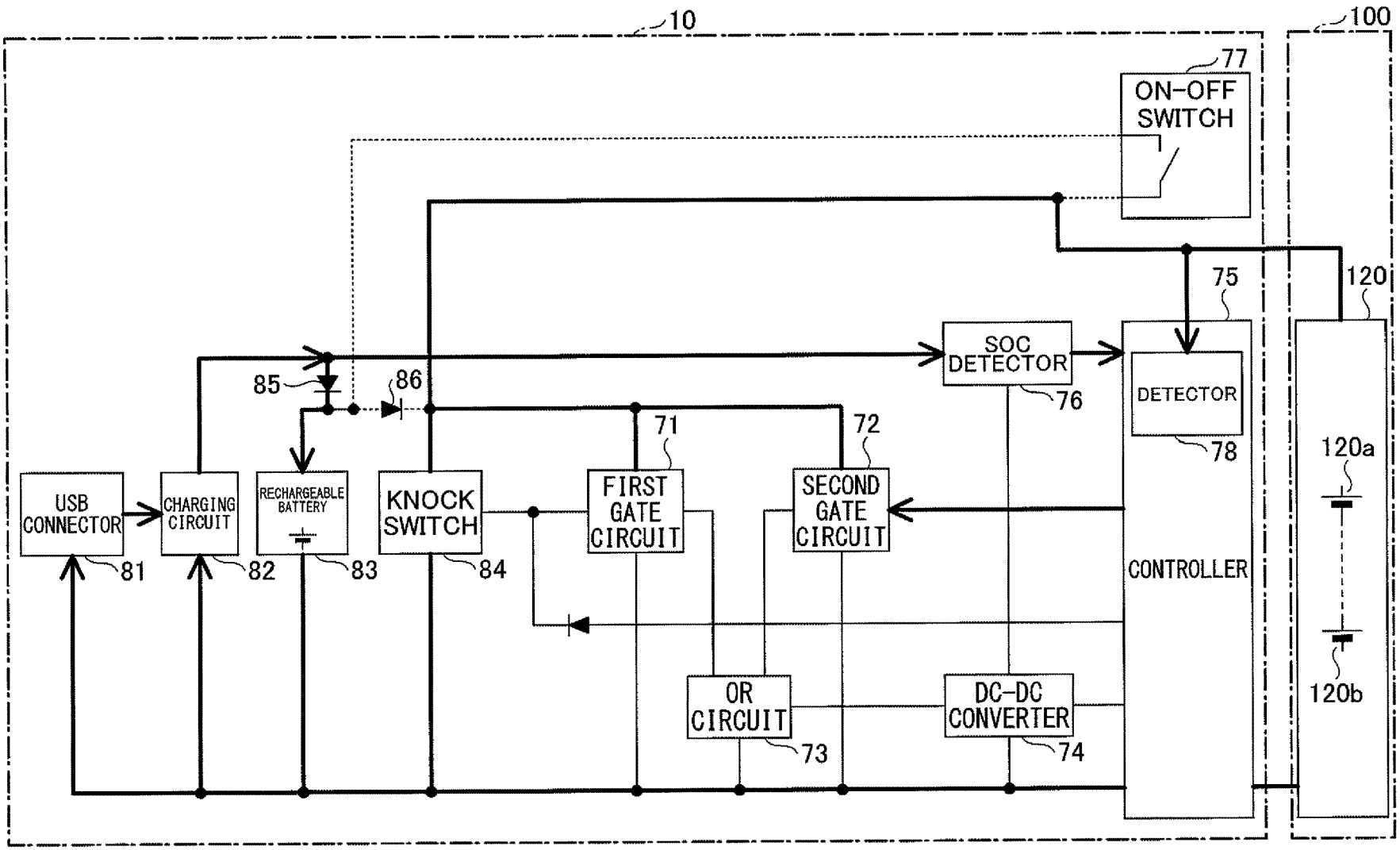

The supply of electric power to the printer 10 is described with reference to FIGS. 16 and 17. FIGS. 16 and 17 are block diagrams illustrating a circuit configuration of the printer 10. The printer 10 includes the USB connector 81, a charging circuit 82, a rechargeable battery 83, a knock switch 84, diodes 85 and 86, a first gate circuit 71, a second gate circuit 72, an OR circuit 73, a DC-DC converter 74, a controller 75 including a central processing unit (CPU), a state-of-charge (SOC) detector 76, and an on-off switch 77. The switch 77 turns on and off in accordance with the state of connection of the cassette 100 to the printer 10. When the cassette 100 is connected to the printer 10, the switch 77 is pressed by the housing 110 to turn off. The switch 77 turns on when the cassette 100 is not connected to the printer 10. The switch 77 forms a short circuit when not pressed, and is so positioned in the printer 10 as to be pressed by the housing 110 when the cassette 100 is connected to the opening 51. The battery 83 is housed in the power supply 80. The DC-DC converter 74 converts DC voltage. When a 3.6 V DC voltage is input to the DC-DC converter 74, the DC-DC converter 74 outputs a 3 V DC voltage that is a logic voltage.

The controller 75 includes a detector 78 that detects applied voltage. A 7.2 V voltage is applied from the battery 120, while a 3.6 V voltage is applied from the battery 83. Therefore, the controller 75 can control the printer 10 differently between the time of application of drive voltage with the battery 120 and the time of application of drive voltage with the battery 83 in accordance with the voltage detected by the detector 78. A threshold for distinguishing between driving with the battery 83 and driving with the battery 120 may be set to, for example, 5.5 V.

Driving of the printer 10 using the battery 83 is described with reference to FIG. 16. Referring to FIG. 16, because the cassette 100 is not attached to the printer 10, the switch 77 is closed to form a circuit to supply electric power from the battery 83. Because of the closure of the switch 77, an electric current from the battery 83 bypasses the diode 86. Thus, when the switch 77 is closed, the voltage of the battery 83 is applied to the knock switch 84, the first gate circuit 71, and the second gate circuit 72 via the switch 77. When the knock switch 84 is depressed in this state, a power-on request signal is output to the first gate circuit 71. In response to receiving this signal, the first gate circuit 71 outputs "HIGH" to the OR circuit 73. The OR circuit 73 outputs "HIGH" to the subsequent DC-DC converter 74. The DC-DC converter 74 outputs a logic voltage VDD. As a result, the controller 75 is activated to output a lock signal to the second gate circuit 72. At this point, because the controller 75 continues outputting the lock signal, this state continues even after the knock switch 84 is released. The voltage of the battery 83 is applied to the controller 75 via the switch 77. The controller 75 includes a driver for driving the print head 11 and a driver for driving a motor for rotating the platen roller 12, and the electric power of the battery 83 is supplied to these drivers. The detector 78 detects supply voltage applied to the print head 11, the motor, etc., and the controller 75 performs energy control and print speed control in accordance with the detected voltage.

When driving with the battery 83, the applied voltage is less than 5.5 V. Therefore, the controller 75 executes a process according to the detected voltage, such as low-speed printing control with the battery 83.

Attaching the cassette 100 to the printer 10 and driving the printer 10 with the battery 120 is described with reference to FIG. 17. When driving the printer 10 with the battery 120, unless the battery 83 is disconnected, an excess current flows from the battery 120 of higher voltage to the battery 83 to cause a trouble. According to this embodiment, an excess current is prevented from flowing to the battery 83.

Referring to FIG. 17, because the cassette 100 is attached to the printer 10, the switch 77 is open. The voltage of the battery 120 is applied to the controller 75, the knock switch 84, the first gate circuit 71, and the second gate circuit 72. The voltage of the battery 120 is higher than the voltage of the battery 83. Therefore, when the cassette 100 is connected to the printer 10, electric current is prevented from flowing to the battery 83 by the diode 86, and electric power is supplied from the battery 120 to the controller 75, etc. At the same time, the battery 83 is disconnected. When the voltage of the battery 120 is applied to the controller 75, the controller 75 can execute a process according to the applied voltage, such as a high-speed printing process.

When the cassette 100 is attached to the printer 10, the printer 10 can be driven with the battery 120. In parallel with driving with the battery 120, it is possible to charge the battery 83, specifically by supplying electric power, fed through the USB connector 81, from the charging circuit 82 to the battery 83 via the diode 85. When a USB charger is inserted into the USB connector 81, a voltage applied to the charging circuit 82 is at most approximately 5 V. Therefore, the applied voltage is separated from the subsequent circuit by the diode 86 and no electric power is supplied to the controller 75, etc. Therefore, charging is normally performed.

At this point, the output of the charging circuit 82 is also input to the SOC detector 76, and the SOC detector 76 outputs a signal indicating that the battery 83 is being charged to the controller 75. In response to this signal, the controller 75 transmits an unlock signal to the second gate circuit 72 in order to ensure the charging of the battery 83 and stop a printing operation.

When the cassette 100 is detached from the printer 10 during the charging of the battery 83, the detector 78 detects a voltage lower than or equal to a threshold. At this point, the controller 75 checks a connection with the cassette 100. When there is no response from the cassette 100, the controller 75 determines that the cassette 100 is detached from the printer 10. When the cassette 100 returns an acknowledgment, the controller 75 determines the occurrence of an abnormality in the battery 120. In this case, the controller 75 determines whether the battery 83 is being charged. If the battery 83 is being charged and the printer 10 is not performing printing, the controller 75 turns off the printer 10.

When the cassette 100 is attached to the printer 10 during driving the printer 10 with the battery 83, the detector 78 detects an applied voltage exceeding a threshold. At this point, the controller 75 sends a connection check signal to the cassette 100. When the cassette 100 returns an acknowledgment, the controller 75 determines that the cassette 100 is connected, and switches control to high-speed printing control on an as-needed basis. When no acknowledgment from the cassette 100 is detected, the controller 75 determines the occurrence of an abnormality, and displays an error indicator and stops the operation of the printer 10.

The diode 86 is a backup diode in the case of switching between the battery 83 and the battery 120. When the battery 120 is connected, the diode 86 prevents electric current from flowing from the battery 120 to the battery 83. Furthermore, because the voltage of the battery 120 is higher than the voltage of the battery 83, the diode 86 is reversely biased, so that it is possible to drive the printer 10 with the battery 120 independent of charging the battery 83, and it is possible to prevent chattering of the switch 77 when the cassette 100 is detached.

Second Embodiment

Figure 18:
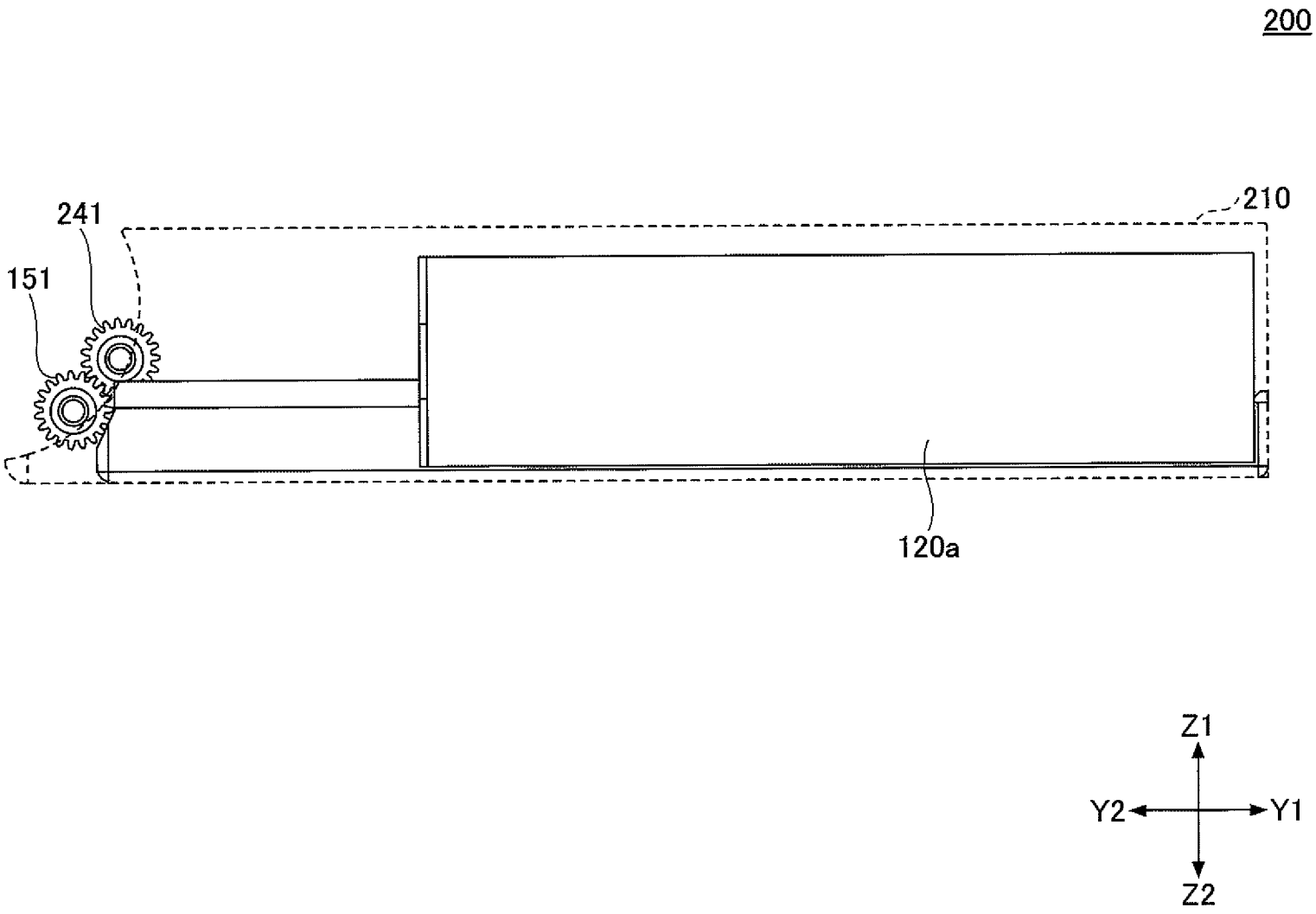
FIG. 18 is a partially phantom side view of a sheet cassette according to a second embodiment.
Figure 19:
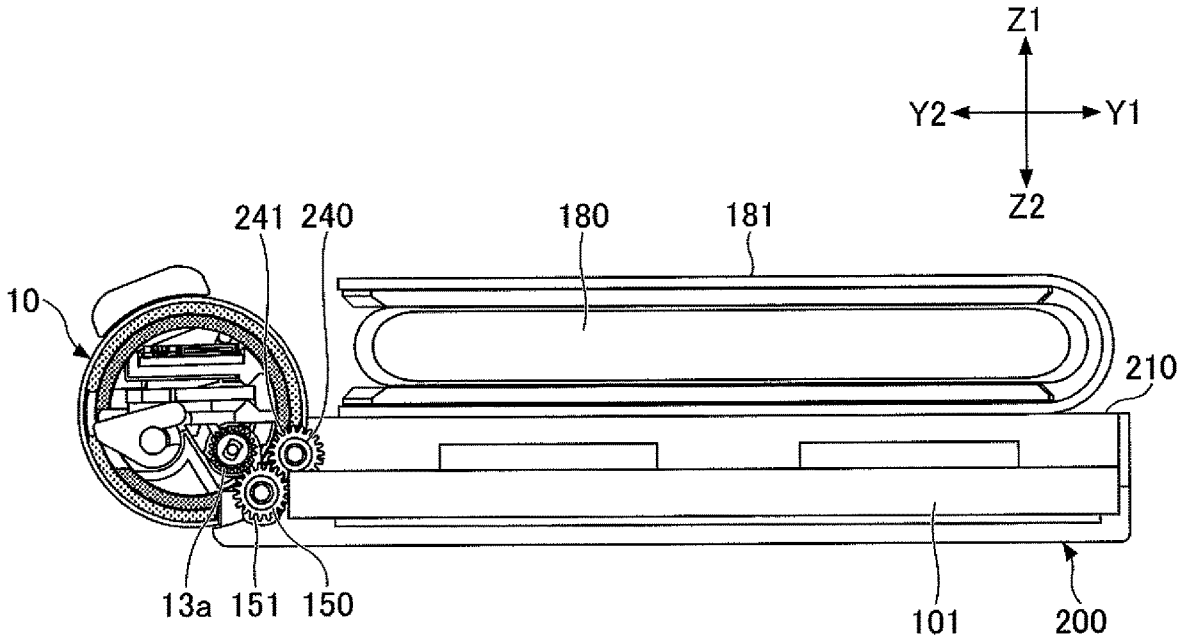
FIGS. 19 and 20 are sectional views of the sheet cassette according to the second embodiment.
Figure 20:
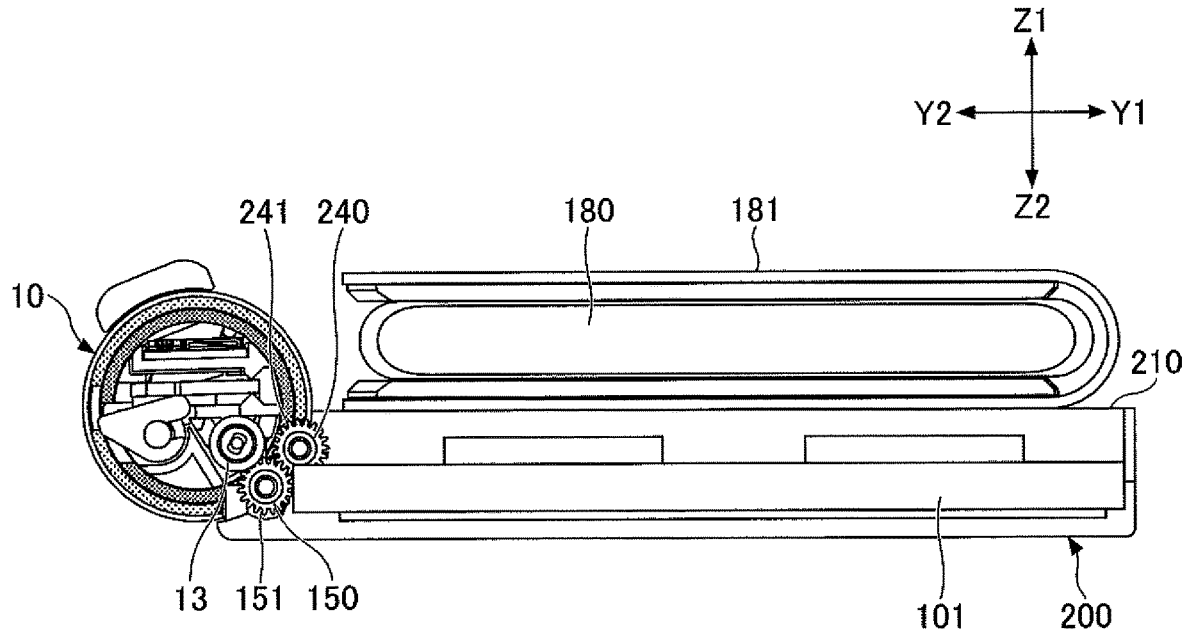

A sheet cassette 200 according to a second embodiment is described below with reference to FIGS. 18 through 20. FIG. 18 is a phantom side view of the cassette 200, seeing through a housing 210. FIGS. 19 and 20 are sectional views of the cassette 200 attached to the printer 10, taken along different planes. According to the cassette 200, no motor for rotating a feed roller 240 is provided, and the gears 151 mesh with gears 241 provided on the feed roller 240.

By attaching the cassette 200 to the printer 10, the gears 13*a* mesh with the gears 151.

Accordingly, when the printer 10 performs printing, the feed roller 13 rotates clockwise to rotate the gears 13*a* clockwise, so that the gears 151 rotate counterclockwise to rotate the assist roller 150 counterclockwise. Furthermore, as the gears 151 rotate counterclockwise, the gears 241 rotate clockwise to rotate the feed roller 240 clockwise. As a result of this operation, the recording sheet 101 contacting the feed roller 240 is conveyed toward and fed into the printer 10.

According to this embodiment because no motor for conveying a recording sheet is necessary, it is possible to save power.

In other respects than those described above, the second embodiment may be the same as the first embodiment.

Third Embodiment

Figure 21:
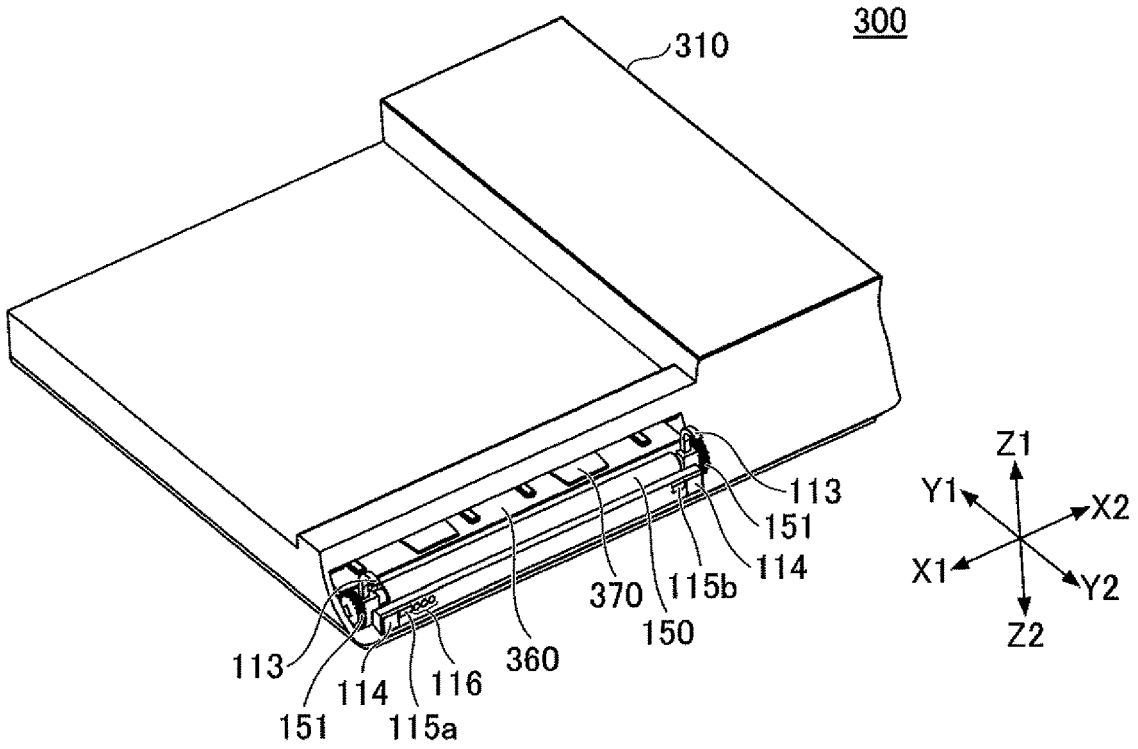
FIGS. 21 and 22 are perspective views of a sheet cassette according to a third embodiment.
Figure 22:
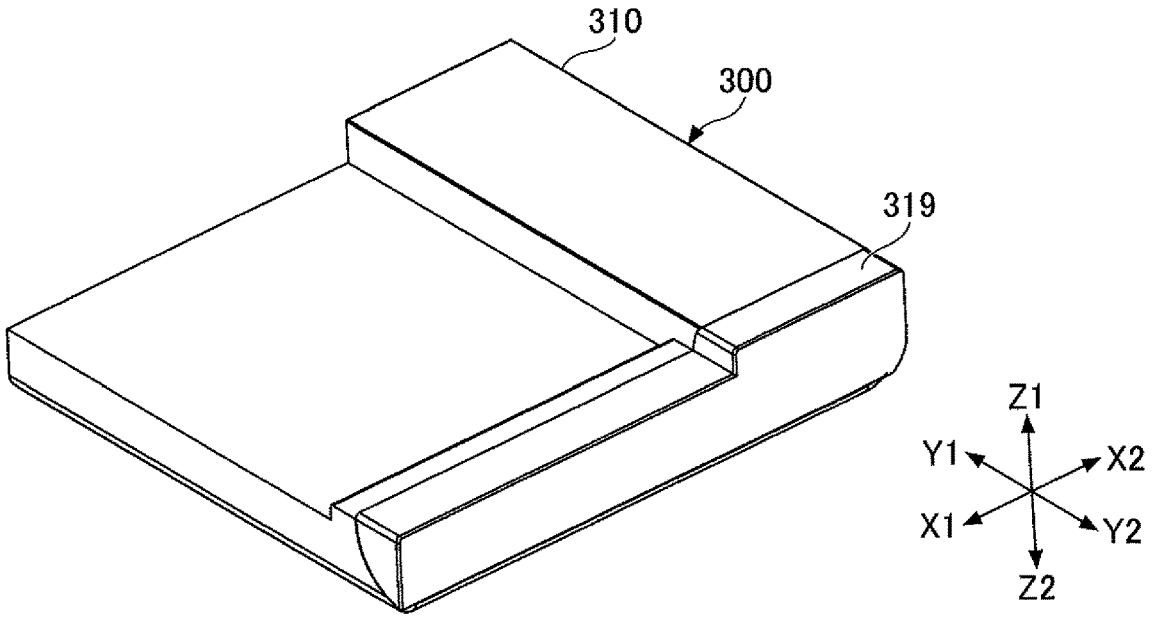
Figure 23:
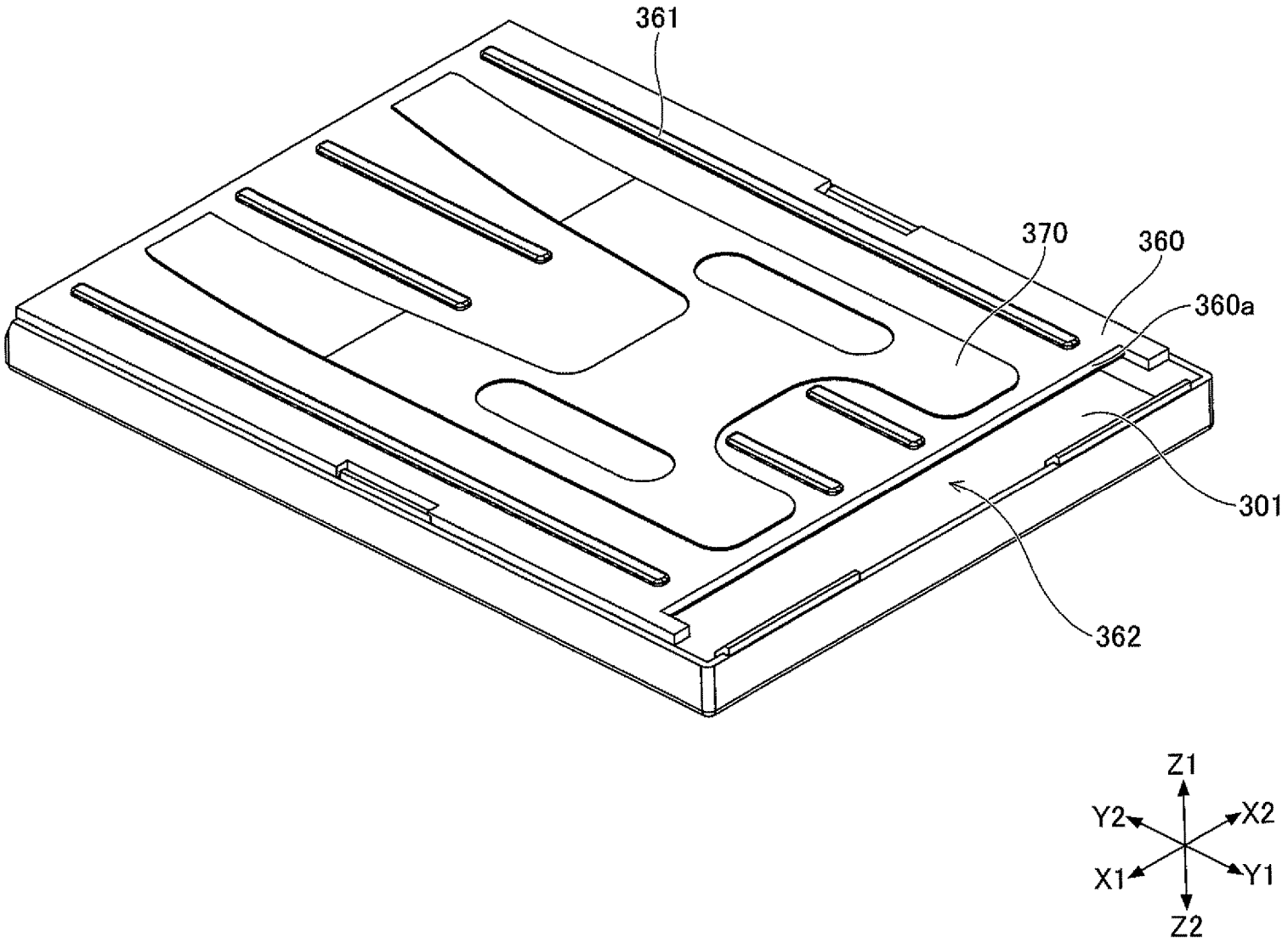
FIG. 23 is a diagram illustrating a structure of the sheet cassette according to the third embodiment.
Figure 24:
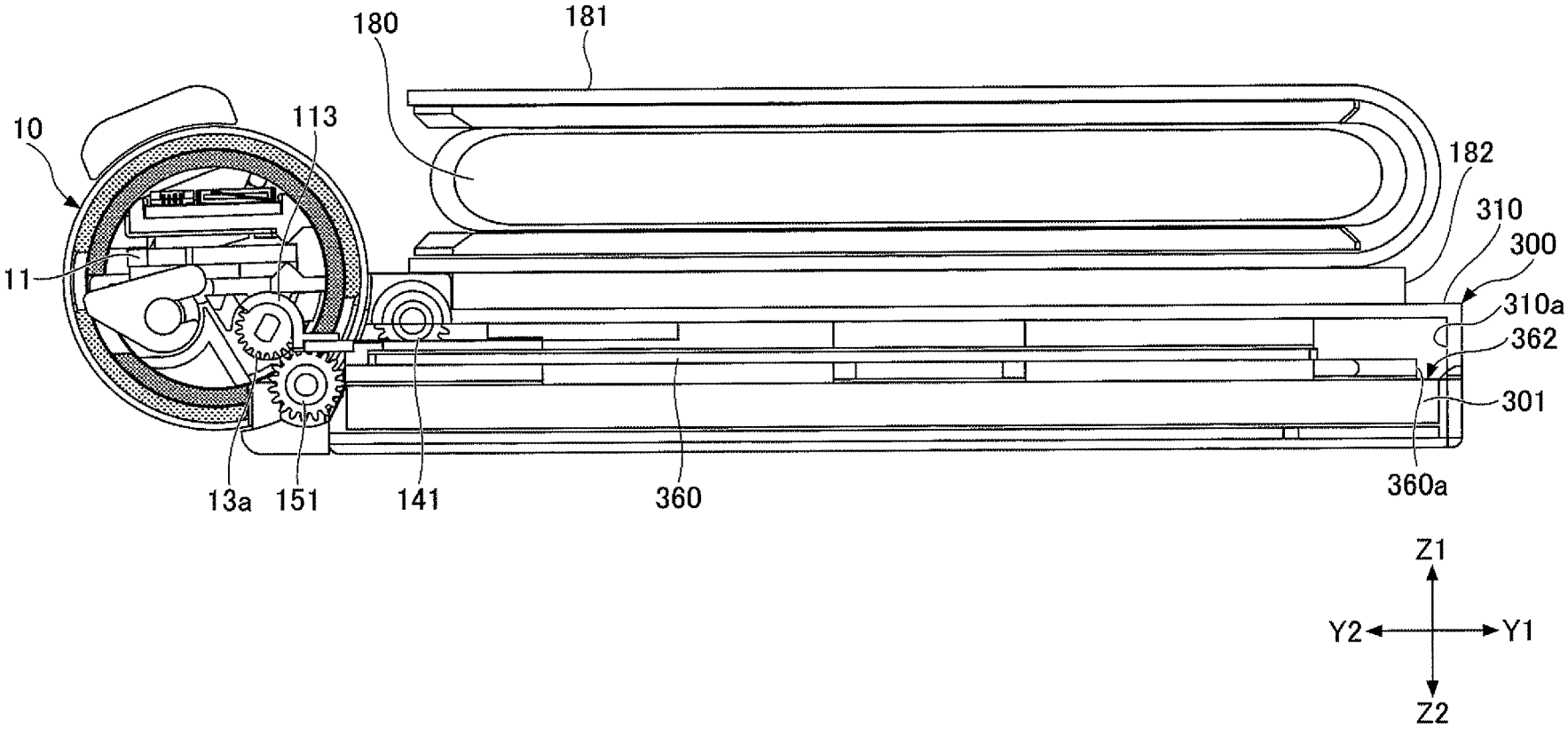
FIG. 24 is a sectional view of the sheet cassette according to the third embodiment.

A sheet cassette 300 according to a third embodiment is described below with reference to FIGS. 21 through 24. The cassette 300 is compatible with fanfold paper. FIGS. 21 and 22 are perspective views of the cassette 300. FIG. 23 is a diagram illustrating the inside of the cassette 300. FIG. 24 is a sectional view of the cassette 300 attached to the printer 10.

The cassette 300 includes a housing 310, in which folded fanfold paper 301 is placed below on the Z2 side of a partition plate 360. That is the partition plate 360 defines a storage part below the partition plate 360 in the housing 310. A spring 370 is attached to the Z1 surface of the partition plate 360. Furthermore, in order to smoothly convey the fanfold paper 301, ribs 361 protruding in the Z1 direction and extending along the Y direction are provided on the Z1 surface of the partition plate 360. An opening 362 for pulling out the fanfold paper 301 from the lower side to the upper side of the partition plate 360 is provided on the Y1 side of the partition plate 360, specifically between a Y1 edge 360*a* of the partition plate 360 and an inner wall surface 310*a* of the housing 310 as illustrated in FIG. 24. This allows part of the fanfold paper 301 placed below the partition plate 360 to be placed onto the spring 370 on the upper side of the partition plate 360 through the opening 362. The spring 370 lifts the fanfold paper 301 upward in order to facilitate feeding of the fanfold paper 301 to the printer 10.

As illustrated in FIG. 21, when the cassette 300 is not connected to the printer 10, the claws 113, the magnets 114, the electrode terminals 115*a* and 115*b*, the communication terminals 116, and the assist roller 150 on the front side of the cassette 300 are exposed. Therefore, as illustrated in FIG. 22, a front cover 319 may be attached to the front side of the cassette 300 so as to make it possible to carry the cassette 300 even when the cassette 300 is disconnected from the printer 10.

Use of the cassette 300 makes it possible to perform printing on the fanfold paper 301 using the printer 10.

In other respects than those described above, the third embodiment may be the same as the first embodiment.

Although the one or more embodiments of the present invention have been described heretofore, the present invention is not limited to these embodiments, and various variations and modifications may be made without departing from the scope of the present invention.

What is claimed is:

1. A sheet cassette attachable to a portable printer, the sheet cassette comprising:

a storage part configured to store a recording sheet;

a battery; and a plurality of electrode terminals configured to be connected to electrode terminals of the portable printer such that electric power of the battery is supplied to the portable printer through the plurality of electrode terminals when the sheet cassette is attached to the portable printer, the plurality of electrode terminals being provided one at each of ends of a surface of the sheet cassette, the surface being configured to be attached to the portable printer.

2. The sheet cassette as claimed in claim 1, further comprising:

a feed roller configured to convey the recording sheet; and a motor configured to rotate the feed roller.

3. The sheet cassette as claimed in claim 1, wherein a voltage of the battery is higher than a voltage of a battery provided in the portable printer.

4. The sheet cassette as claimed in claim 1, further comprising:

an assist roller configured to rotate in tandem with a feed roller provided in the portable printer.

5. The sheet cassette as claimed in claim 1, further comprising:

a housing configured to come into contact with a switch provided in the portable printer when the sheet cassette is attached to the portable printer, and to come out of contact with the switch when the sheet cassette is detached from the portable printer, so as to turn on and off the switch.

6. A sheet cassette comprising:

a housing;

a partition plate provided in the housing, the partition plate defining a storage part configured to store recording paper in the housing; and a roller provided at a position facing a first end of the partition plate, the roller being configured to rotate to feed the recording paper, wherein an opening through which the recording paper passes is formed between a second end of the partition plate opposite to the first end and an inner wall surface of the housing.

7. The sheet cassette as claimed in claim 6, further comprising:

a spring provided on a surface of the partition plate facing away from a bottom of the storage part.

8. A printing apparatus comprising:

a printer;

a sheet cassette connected to the printer and storing a first battery;

a second battery stored in the printer;

a control part configured to detect a voltage applied to the control part from the first battery or the second battery and control the printer in accordance with the detected voltage; and a switch configured to turn on and off in accordance with a state of connection of the printer and the sheet cassette, wherein when the sheet cassette is connected to the printer, the switch turns off to electrically disconnect the second battery from the control part.

* * * * *